US008103024B2

(12) United States Patent
Bachmann et al.

(10) Patent No.: US 8,103,024 B2
(45) **Date of Patent: *Jan. 24, 2012**

(54) DOOR WITH STRUCTURAL COMPONENTS CONFIGURED TO RADIATE ACOUSTIC ENERGY

(75) Inventors: Wolfgang Bachmann, Grevenbroich (DE); Gerhard Krump, Schwarzach (DE); Hans-Juergen Regl, Regensburg (DE); Andreas Ziganki, Mettmann (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 935 days.

This patent is subject to a terminal disclaimer.

(21) Appl. No.: 11/500,157

(22) Filed: Aug. 7, 2006

(65) Prior Publication Data

US 2007/0110264 A1 May 17, 2007

Related U.S. Application Data

(63) Continuation of application No. 09/665,894, filed on Sep. 20, 2000, now Pat. No. 7,088,836.

(51) Int. Cl.
*H04R 25/00* (2006.01)

(52) U.S. Cl. ..... 381/152; 381/387; 381/87

(58) Field of Classification Search ..... 381/152, 381/190–191, 423, 426, 337, 431, 87, 349, 381/386, 387; 296/146.1; 49/501, 502
See application file for complete search history.

(56) References Cited

U.S. PATENT DOCUMENTS 3,247,925 A 4/1966 Warnaka
3,347,335 A 10/1967 Watters
3,609,253 A 9/1971 Ashworth
4,499,340 A 2/1985 Kasai et al.
4,514,599 A 4/1985 Yanagishima et al.
4,551,849 A 11/1985 Kasai et al.
4,807,294 A 2/1989 Iwata et al.
4,862,011 A * 8/1989 Wright ..... 307/10.1
5,901,231 A 5/1999 Parrella et al.
5,902,004 A 5/1999 Waltz et al.
6,164,408 A * 12/2000 Lamm et al. ..... 181/30

(Continued)

FOREIGN PATENT DOCUMENTS

DE 19610678 1/1997

(Continued)

*Primary Examiner* — Davetta W Goins
*Assistant Examiner* — Phylesha Dabney
(74) *Attorney, Agent, or Firm* — O'Shea Getz P.C.

(57) ABSTRACT

A door leaf includes a stiff, light structural part that maintains fed-in vibrational energy and, by flexural waves, propagates this energy in at least one active surface perpendicular to its thickness to distribute resonance mode vibration components over at least one surface, which has specified, preferred locations or sites within it for transducer devices, which are affixed on the structural part at one of the locations or sites to set the structural part into vibration and to allow it to resonate, thus creating an acoustic radiator that delivers an acoustic output signal when it vibrates in resonance, the front and/or the rear cover panel of the door leaf being part of the stiff, light structural component. The transducer(s) is/are situated between the cover panels. This arrangement provides a door with a loudspeaker function, which needs no extra volume compared to an ordinary door, and which is able to provide sound reliably and comprehensively to one or more rooms, which adjoin this door acting as a loudspeaker. Advantageously, additional loudspeakers or loudspeaker boxes are not required in a room that receives sound by this door with loudspeakers.

14 Claims, 3 Drawing Sheets

U.S. PATENT DOCUMENTS 6,188,775 B1 2/2001 Azima et al.
6,198,831 B1 3/2001 Azima et al.
6,201,878 B1 3/2001 Azima et al.
6,226,927 B1 * 5/2001 Bertolini et al. ..... 49/502
6,320,967 B1 11/2001 Azima et al.
6,332,029 B1 12/2001 Azima et al.
6,356,641 B1 3/2002 Warnaka et al.
6,367,202 B1 4/2002 Reed et al.
6,377,695 B1 4/2002 Azima et al.
6,397,972 B1 6/2002 Bank et al.
6,411,723 B1 6/2002 Lock et al.

FOREIGN PATENT DOCUMENTS

WO WO 97/09843 * 3/1997

* cited by examiner

DOOR WITH STRUCTURAL COMPONENTS CONFIGURED TO RADIATE ACOUSTIC ENERGY

PRIORITY INFORMATION

This application is a continuation of Ser. No. 09/665,894 filed Sep. 20, 2000 now U.S. Pat. No. 7,088,836.

BACKGROUND OF THE INVENTION

The present invention relates to the field of loudspeakers, and in particular to a door that acts as a radiant acoustical structure.

U.S. Pat. No. 3,247,925 discloses a flat panel loudspeaker, which has a multimodal resonance radiator element formed by two films between which is arranged a core consisting of high resistance foam or a core with a honeycomb structure. This radiator is driven by electrodynamic transducers that excite the radiator to multimodal resonance in accordance with a fed-in electrical audio signal to yield a corresponding acoustic audio signal.

U.S. Pat. No. 3,247,925 describes a woofer having an electromagnet disposed on the floor of its cubical housing. A flat, first diaphragm fastened on the housing like an intermediate ceiling is seated on this electromagnet. The housing ceiling is formed by a second flat diaphragm, which is mechanically connected to the flat first diaphragm by a column that includes several honeycomb-shaped columns to transmit soundwaves.

A motor-vehicle door capable of housing electrical equipment is disclosed in the published German application DE 196 54 956 A1. The motor-vehicle door accommodates an electrical drive to move the outside mirror, an electrical drive to raise and lower the window, and a relatively large loudspeaker to radiate sound. To supply the electrical equipment with electrical current and to control this equipment by electrical control signals, electric contacts are situated at the door lock of the motor vehicle door. When the door is closed, these are connected to electric contacts that are situated on a closure element, which is disposed on the car body and positively engages the door lock. One disadvantage of this motor vehicle door is that a relatively large loudspeaker must be built into the door to radiate sound.

Therefore, there is a need for a door that includes structural components configured to radiate acoustical energy.

SUMMARY OF THE INVENTION

A door leaf includes a stiff, light structural part that maintains fed-in vibrational energy and, by flexural waves, propagates this energy in at least one active surface perpendicular to its thickness to distribute resonance mode vibration components over at least one surface, which has specified, preferred locations or sites within it for transducer devices, which are affixed on the structural part at one of the locations or sites to set the structural part into vibration and to allow it to resonate, thus creating an acoustic radiator that delivers an acoustic output signal when it vibrates in resonance, the front and/or the rear cover panel of the door leaf being part of the stiff, light structural component. The transducer(s) is/are situated between the cover panels. This arrangement provides a door with a loudspeaker function, which needs no extra volume compared to an ordinary door, and which is able to provide sound reliably and comprehensively to one or more rooms, which adjoin this door acting as a loudspeaker. Advantageously, additional loudspeakers or loudspeaker boxes are not required in a room that receives sound by this door with loudspeakers.

In a preferred embodiment of the invention, the signal is supplied through an electrical connection via the hinge. It is thus possible to maintain the loudspeaker function of the door leaf at every opening angle, since there exists a secure connection from the signal source, via the hinge, to the transducer that is situated in the door leaf. This assumes the usual arrangement, in which the signal source, for example the stereo system with an amplifier, is situated outside the door.

It has proven especially advantageous to provide a switching element that detects the open state of the door leaf and interrupts transmission of the signal through the hinge to the transducer when the door is open, and allows signal transmission when the door is closed. An optimized and specified sound irradiation with a specific directional characteristic is thus provided in relatively simple fashion.

According to another preferred development of the invention, the signal is conducted over corresponding contacts on the door leaf and the frame. This special arrangement of the contacts on the door leaf and on the frame ensures that contact is made only when the door is closed, so that no additional switching element is needed to achieve the desired, preferred acoustic irradiation.

In a preferred embodiment, several drivers (e.g., electrodynamic and/or piezoelectric drivers) are used as transducers to drive the stiff, light structural part with the front and/or rear cover panel. The plurality of transducers and their optimized arrangement on the structural part and also the choice of different types of transducers make it possible to create an optimized acoustic radiator that has good acoustic reproduction properties over a broad frequency range. In particular, the various transducers have applied to them an electrical acoustic signal, after this signal has been frequency-divided by a frequency-dividing network. This makes it possible to optimize the signal infeed, the disposition of the transducers, and the electrical signal supplied to the transducers.

According to an especially preferred design of the invention, flexible, damping support elements are situated between the cover panels with the two structural components that individually or jointly are excited to multimodal resonances. These elements on the one hand make it possible to stiffen the door leaf and the light components against one another, and on the other hand they prevent transmission of the vibrations (e.g., from the structural part with the front cover panel to the other structural part with the rear cover panel). This decouples the front and rear cover panels from the light structural components. With two such light structural parts, a front and a rear cover panel, it is possible to feed one kind of music into one room, which is separated from another room by the door, while another type of audio signal is fed into this other room. This acoustic separation achieves an especially high degree if care is taken to make the door sufficiently stable.

According to another embodiment, the front and rear cover panels are connected by an acoustic sandwich core, preferably including a Nomex honeycomb structure, an aluminum honeycomb structure or high resistance foam. Together they form a stiff, light structural component capable of multimode resonance. This arrangement is also called an acoustic sandwich. The acoustic sandwich core preferably has one or more recesses, which contain one or more transducers. These excite the structural component containing the front and rear cover panels and the acoustic sandwich core to flexural vibrations and thus make it possible to feed sounds into the rooms which adjoin the door. Furthermore, the door leaf that acts as a loudspeaker proves to be especially stiff with a simple and durable structure. Nevertheless, this door leaf is light, since the acoustic sandwich core has a relatively low density.

A special advantage of a door acting as a loudspeaker is that the adjoining masonry prevents an acoustic short circuit.

Preferred transducers are electrodynamic inertial vibration drivers, which directly excite the structural component to multimodal vibrations and thus turn this structural component into an acoustic radiator. These inertial vibration drivers are especially suited for such loudspeakers.

The front and/or rear cover panels may include a surface structure formed by a single-layer or a multi-layer criss-cross veneer, especially one of pinewood. This surface design on the one hand imparts to the structural part the stiffness that is necessary for this part to have the property of a multimodal radiator, and, on the other hand, the door that acts as a loudspeaker is thus given the appealing visual appearance of a wooden door. This especially encourages acceptance of this type of door.

It has proven especially advantageous to divide the front and/or the rear cover panel into various zones, which are equipped with appropriate structural parts capable of flexural vibrations and acting as multimodal acoustic radiators. The various zones of the front cover and/or the rear cover can thus be designed with different acoustic properties, significantly improving the acoustic experience from the loudspeaker door. For example, this design makes it possible to design one zone as a woofer and another zone as a tweeter. In corresponding fashion, one zone can be designed as the right speaker and another zone as the left speaker, and can be driven as such. The electronics needed to separate the corresponding signals, for example a frequency-dividing network or a channel-separating stage, preferably are disposed in the interior of the door leaf. This greatly simplifies the signal infeed, since only a single, complete signal needs to be fed in for all the zones of the door. This is preferably affected through the door hinge.

According to yet another embodiment, the loudspeaker door has one or more bass reflex openings. The bass reflex openings preferably are disposed in the door leaf in the area of the transducers or the electronic components to provide cooling of these components by air circulation through the bass reflex openings. This ensures reliable cooling of the loudspeakers, which are subject to heating during operation, thus substantially increasing their useful life and reducing their failure rate. In particular, such bass reflex openings make it possible to accommodate in the door leaf not only frequency-dividing networks but also active components such as amplifier stages. This is made possible in an especially advantageous manner by an arrangement of several transducers with several bass reflex openings.

In a preferred design of the invention, the front and/or rear cover panels, with the stiff, light structural part have a clamping device that makes it possible to tension the stiff, light structural component with a view to changing and improving the acoustic properties of the stiff, light structural component. The clamping device surrounds the light structural component and transfers the tension from the frame of the door leaf, through the relevant cover panels, to the light structural component.

The present invention is not only suited for room doors, but also for cabinet doors, where the door leaf is not mounted on a hinge but is pivotally mounted in the body of a piece of furniture.

These and other objects, features and advantages of the present invention will become apparent in light of the following detailed description of preferred embodiments thereof, as illustrated in the accompanying drawings.

DETAILED DESCRIPTION OF THE INVENTION

Figure 1:
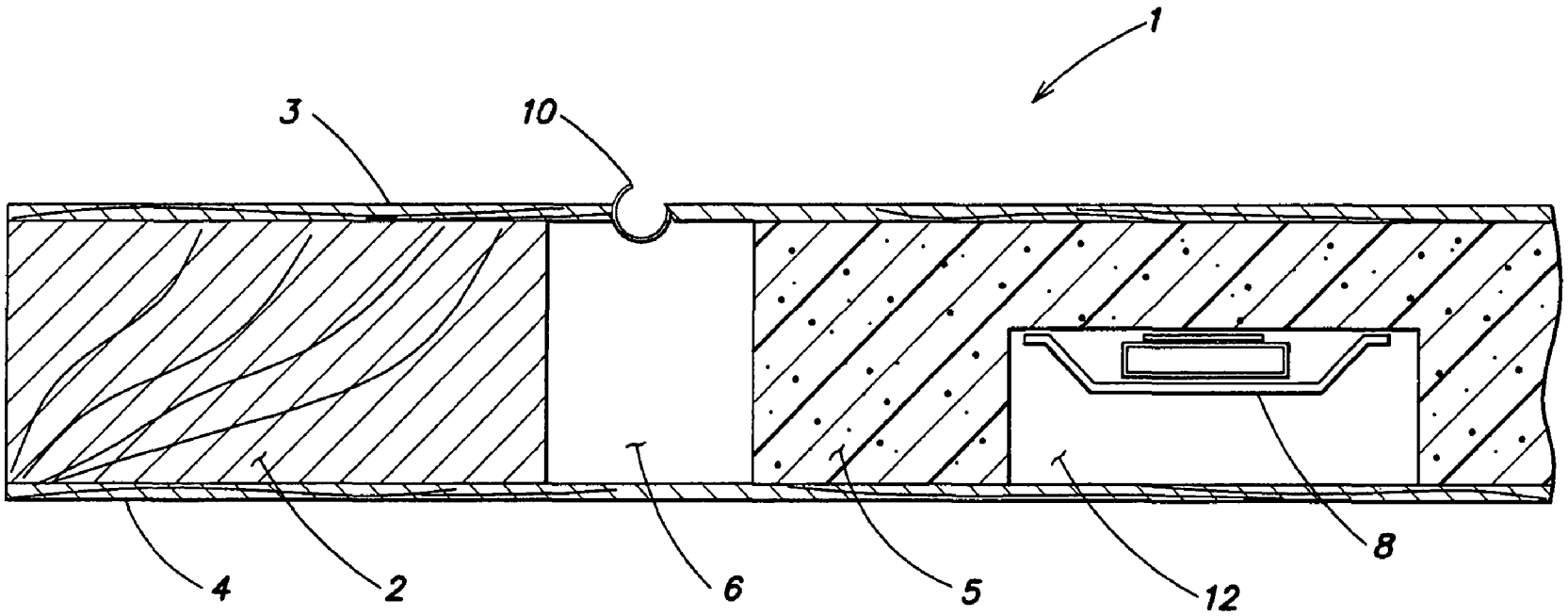
FIG. 1 illustrates a first embodiment of the inventive door leaf, partially in section.

FIG. 1 illustrates, partially in section, a segment of a door leaf 1 that acts as a loudspeaker. The door leaf 1 has a frame 2 with front and rear cover panels 3, 4, respectively. The frame 2 and the front and rear cover panels 3, 4 bound an interior space 6 of the door leaf 1. An acoustic sandwich core 5 of highly resistant foam is disposed within the interior space 6 and extends from the front cover panel 3 to the rear cover panel 4. The front cover panel 3, the acoustic sandwich core 5, and the rear cover panel 4 form a stiff, light structural part, which may be excited to flexural vibrations in such a way that it acts as a multimodal resonance radiator and delivers an acoustic output signal when it vibrates in resonance.

The acoustic sandwich core 5 has a recess 12, which is occupied by a transducer 8. When excited by an electric acoustic signal, the transducer excites the acoustic sandwich core 5, together with the adjoining cover panels 3 and 4, to flexural vibrations. The transducer 8 is designed as an electrodynamic inertial vibration driver. The front cover panel 3 contains a clamping device 10, including a diaphragm and situated between the acoustic sandwich core 5 and the frame 2. The clamping device keeps the front cover panel 3 under tension in the region of the acoustic sandwich core 5 to yield a favorable acoustic design. Both the front cover panel 3 and the rear cover panel 4 radiate sound. Therefore, the door leaf 1 radiates sound to the rooms on both sides. With this arrangement, the acoustic signals generated by the transducer 8 are identical on both sides of the door leaf. This type of door leaf, acting as a loudspeaker, is especially suitable for use in schools, museums, railroad stations, and similar buildings with a large number of doors, where a large number of rooms should simultaneously receive uniform announcements or other acoustic signals. In the sense of the invention, the most simple and robust door leaves should be used to act as loudspeakers.

In the interest of brevity, when describing the embodiments set forth in FIGS. 2 and 3, only the differences from the door leaf 1 of FIG. 1 will be explained below. In the drawings, the same or corresponding parts of the door leaf 1 carry the same reference symbols.

Figure 2:
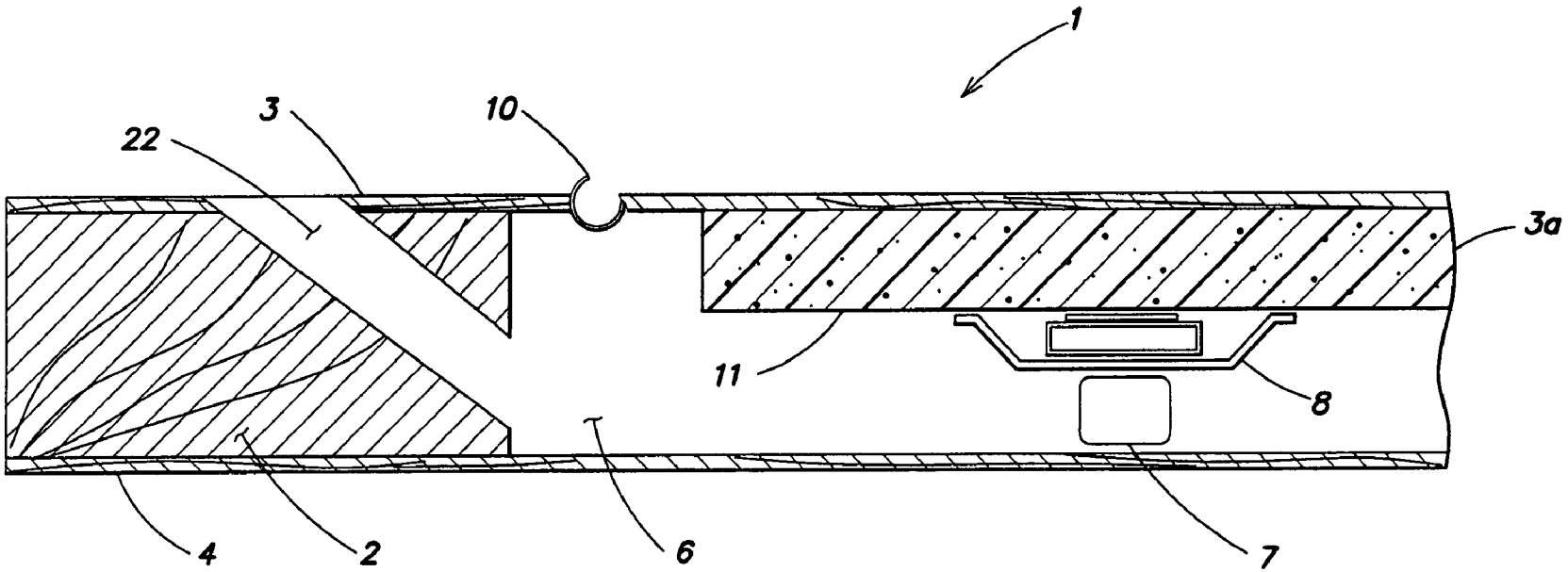
FIG. 2 illustrates a second embodiment of the inventive door leaf, partially in section.

FIG. 2 illustrates a door leaf 1 whose front cover panel 3 is connected to an acoustic sandwich core 11, which is disposed in the interior space 6, but which does not touch the rear cover panel 4. A transducer 8, designed as an electrodynamic inertial vibration driver, as well as a flexible, damping support element 7, are situated between the acoustic sandwich core 11 and the rear cover panel 4. The light structural component, which comprises the acoustic sandwich core 11 and part of the front cover panel 3, is excited to flexural vibrations by the transducer 8, which allows this light structural component to become a multimode resonance radiator. The vibrations of the transducer 8 propagating in the direction of the rear cover panel 4 are intercepted and decoupled by the support element 7 so that only one side of the door leaf 1, on which the front cover panel 3 is situated, is apt to emit sound, while the other side of the door leaf 1 is not apt to emit sound.

The frame 2 of the door leaf 1 has a channel that provides a bass reflex opening 22. The interior space 6 of the door 1 is aerated or vented through the bass reflex opening 22. In this way, the heat generated in the transducer 8, when driving the light structural component, can be dissipated through the bass reflex opening 22. This prevents the loudspeaker components of the door leaf from being overheated, thus greatly increasing the lifetime of the door loudspeaker and preserving its acoustic properties over a long time even under extreme conditions.

Figure 3:
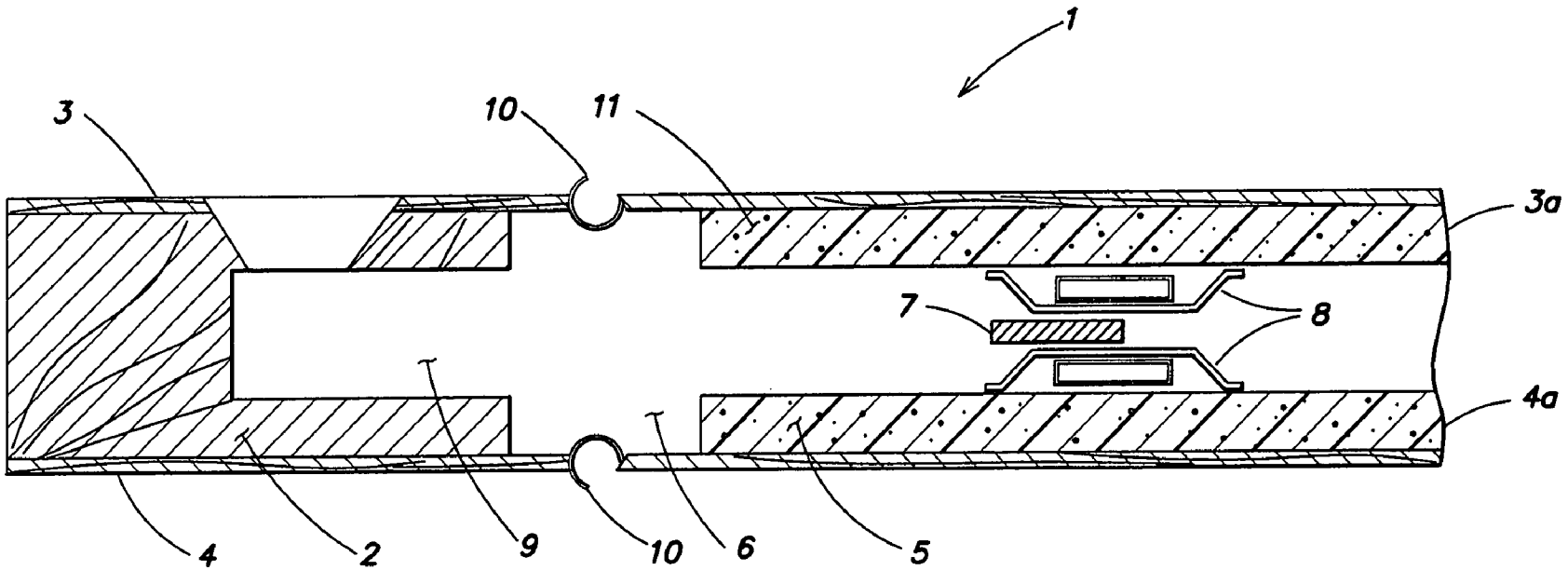
FIG. 3 illustrates a third embodiment of the inventive door leaf, partially in section.

FIG. 3 illustrates a door leaf 1 designed as a double loudspeaker. In this door leaf 1, both the front cover panel 3 and the rear cover panel 4 are each connected to the acoustic sandwich cores 11, 5, respectively, thus forming a front acoustic sandwich 3*a* and a rear acoustic sandwich 4*a*. These acoustic sandwiches 3*a*, 4*a* are spaced apart and form the light structural component. Two electrodynamic transducers 8 are situated between them, driving the acoustic sandwich 3*a*, 4*a* respectively. These two transducers 8 are arranged back-to-back and are connected to one another through a flexible, damping support element 7. This support element 7 makes it possible to decouple the vibrations of the transducers 8 and their associated acoustic sandwiches 3 a, 4*a*.

Besides the front cover panel 3, the rear cover panel 4 is also equipped with a clamping device 10 that is likewise suited to tension the region of the rear cover panel 4, which is rigidly connected to the acoustic sandwich core 5 and forms the acoustic sandwich 4*a*.

The door leaf 1 of FIG. 3 makes it possible to irradiate the two rooms separated by the door with different acoustic signals. This permits broad application of this door leaf 1, especially since the special design of the bass reflex opening 9 provides effective heat dissipation in combination with an advantageous improvement of the acoustics of the resulting loudspeaker.

The transducers 8 used in the embodiments of FIGS. 1 to 3 have electric signals applied to them, which are conducted to the transducer 8 via door elements which are not shown here, namely the door frame, the hinges or bands, the frame 2, the interior space 6, and, where applicable, the acoustic sandwich core 5. A frequency-dividing network to divide the electrical signals and an amplifier to amplify these electrical acoustic signals can be situated along the signal path in the frame 2, neither of these being shown here in the interest of ease of illustration.

According to another aspect of the present invention, two or more loudspeaker systems with their own drivers, acoustic sandwiches, and possibly cover panel segments can be respectively associated with one side of the door leaf, so that the door leaf at the same time forms loudspeakers for different frequency ranges, for example high frequency, medium frequency, and low frequency.

Although the present invention has been shown and described with respect to several preferred embodiments thereof, various changes, omissions and additions to the form and detail thereof, may be made therein, without departing from the scope and spirit of the invention.

What is claimed is:

1. A door, comprising:

a door frame; and a door leaf that swings on hinges in the door frame, with a front and a rear cover panel, and with at least one transducer device mounted therein, where the door leaf acts as a loudspeaker and includes a stiff, light structural part that maintains fed-in vibrational energy and by flexural waves propagates this energy in at least one active surface perpendicular to its thickness to distribute resonance mode vibration components over at least one surface, which has specified, preferred locations or sites within it for transducer devices, which are entirely and exclusively affixed on the structural part at one of the locations or sites to set the structural part into vibration and to allow it to resonate, thus creating an acoustic radiator that delivers an acoustic output signal when it vibrates in resonance, the front and/or the rear cover panel of the door leaf being part of the stiff, light structural component, where the signals are conducted from the door frame to the door leaf over at least one hinge.

2. The door of claim 1, where corresponding contacts for signal conduction are situated on the door leaf and on the frame associated therewith.

3. The door of claim 1, further comprising a flexible, damping support element situated between the front and rear cover panels.

4. The door of claim 1, where the transducers include electrodynamic inertial vibration drivers.

5. A door, comprising:

a door frame; and a door leaf that swings on hinges in the door frame, with a front and a rear cover panel, and with at least one transducer device mounted therein, where the door leaf acts as a loudspeaker and includes a stiff, light structural part that maintains fed-in vibrational energy and by flexural waves propagates this energy in at least one active surface perpendicular to its thickness to distribute resonance mode vibration components over at least one surface, which has specified, preferred locations or sites within it for transducer devices, which are entirely and exclusively affixed on the structural part at one of the locations or sites to set the structural part into vibration and to allow it to resonate, thus creating an acoustic radiator that delivers an acoustic output signal when it vibrates in resonance, the front and/or the rear cover panel of the door leaf being part of the stiff 1i s ht structural component, where the door leaf has at least one bass reflex opening.

6. The door of claim 5, where the front cover panel is equipped with a clamping device that maintains the stiff, light structural part of the front and/or rear cover panel under an adjustable amount of tension.

7. A door leaf that receives an electrical acoustic signal, comprising:

front and rear parallel cover panels that sandwich an acoustic sandwich core that includes a recess within which a transducer that receives an input signal indicative of the electrical acoustic signal is mounted, where the transducer emits an audio signal that excites the front cover panel and the acoustic sandwich core such that the front cover panel and the acoustic sandwich core provide a multimodal resonance radiator that delivers an acoustic output signal to the area adjacent to the front cover panel, and where the transducer is disposed between the front and the rear cover panels, further comprising a second transducer mounted in a second recess between the front and rear parallel cover panels, where the second transducer is orientated to drive the rear parallel cover panel to resonance in order to deliver a rearward launched acoustic output wave, and the first and second transducers are separated by a flexible damping support element.

8. The door leaf of claim 7, where the transducer comprises an electrodynamic inertial vibration driver.

9. The door leaf of claim 7, further comprising an adjustable clamping device that controls the amount of tension in the region of the acoustic sandwich core to selectively change the acoustic properties of the front cover and the acoustic sandwich core.

10. The door leaf of claim 7, where the front cover and the rear cover include multi-layer pinewood veneer.

11. The door leaf of claim 7, where the transducer comprises a piezoelectric driver.

12. The door leaf of claim 7, where the acoustic sandwich core comprises a nomex honeycomb structure.

13. The door leaf of claim 7, where the acoustic sandwich core comprises an aluminum honeycomb structure.

14. The door leaf of claim 7, where the acoustic sandwich core comprises a high resistance foam.

* * * * *

UNITED STATES PATENT AND TRADEMARK OFFICE

CERTIFICATE OF CORRECTION

PATENT NO. : 8,103,024 B2
APPLICATION NO. : 11/500157
DATED : January 24, 2012
INVENTOR(S) : Bachmann et al.

It is certified that error appears in the above-identified patent and that said Letters Patent is hereby corrected as shown below:

Column 6
Line 40, please delete "1i s ht" and insert --light--

Signed and Sealed this
Twenty-seventh Day of March, 2012

David J. Kappos

David J. Kappos
*Director of the United States Patent and Trademark Office*